US005184410A

United States Patent [19]

Hamilton

[11] Patent Number: 5,184,410

[45] Date of Patent: Feb. 9, 1993

[54] PIVOTING SHOE CONSTRUCTION

[76] Inventor: Paul R. Hamilton, 34722 Hillside La., Piedmont, Ohio 43983

[21] Appl. No.: 714,505

[22] Filed: Jun. 13, 1991

[51] Int. Cl.[5] ..... A43B 21/00; A43B 11/00

[52] U.S. Cl. ..... 36/105; 36/103; 36/138; 604/293

[58] Field of Search ..... 36/97, 103, 98, 105, 36/50, 2.6, 136, 164, 132, 165; 128/114.1, 382, 383; 604/290, 293, 304, 308

[56] References Cited

U.S. PATENT DOCUMENTS

| | | | |
|---|---|---|---|
| 917,602 | 4/1909 | Helflinger | 36/138 |
| 1,081,678 | 12/1913 | Langerak | 36/105 |
| 2,450,250 | 9/1948 | Napton | 36/103 |
| 2,452,502 | 10/1948 | Tarbox | 36/138 |
| 2,452,649 | 11/1948 | Graves | 36/138 |
| 2,815,588 | 12/1957 | Ruane | 36/138 |
| 3,146,535 | 9/1964 | Owings | 36/138 |
| 3,550,593 | 12/1970 | Kaufman | 604/293 |
| 4,622,035 | 11/1986 | Palmer et al. | 604/293 |
| 4,877,018 | 10/1989 | Ikebe et al. | 604/293 |
| 4,982,515 | 1/1991 | Sartor | 36/97 |

*Primary Examiner*—Steven N. Meyers
*Attorney, Agent, or Firm*—Leon Gilden

[57] ABSTRACT

A shoe wherein the organization pivots about a pivot hinge mounted coextensively between an intersection of the shoe heel and the shoe sole permitting pivoting separation of a forward portion of the shoe relative to a rear portion of the shoe, wherein the forward portion of the shoe includes a bifurcated edge mounted at each right and left side thereof to receive an associated flange of the rear portion of the shoe, with a locking plunger mounted within each flange of the rear portion of the shoe. A modification of the invention includes a cavity directed within the forward portion of the shoe positioned medially and orthogonally relative to each slot to receive a deodorant packet therefrom, wherein the deodorant packet directs a deodorizing fluid through a permeable inner liner of the shoe construction.

1 Claim, 4 Drawing Sheets

PIVOTING SHOE CONSTRUCTION

BACKGROUND OF THE INVENTION

1. Field of the Invention

The field of invention relates to shoe organizations, and more particularly pertains to a new and improved pivoting shoe construction wherein the same is arranged for pivotment of a forward portion of the shoe relative to the rear portion of the shoe.

2. Description of the Prior Art

For ease of entry into a shoe, various shoe organizations have been presented. Such a typical organization is exemplified in U.S. Pat. No. 3,192,651 to Smith wherein a rear portion of a shoe includes an associated buckle structure to permit removal of the rear portion of the shoe for ease of entry therein.

U.S Pat. No. 2,619,744 to Mattes utilizes a button structure to removably mount a rear tab of a shoe relative to the sides thereof to provide rear entry into an associated shoe.

U.S. Pat. No. 4,095,356 to Robran sets forth a boot permitting pivotment of a rear portion of the boot relative to a forward portion of the boot.

U.S. Pat. No. 4,178,703 to Pols sets forth a shoe member to be worn over a cast utilizing hook and loop fasteners to secure straps in surrounding relationship relative to a cast.

As such, it may be appreciated that there continues to be a need for a new and improved pivoting shoe construction as set forth by the instant invention which addresses both the problems of ease of use as well a effectiveness in construction and in this respect, the present invention substantially fulfills this need.

SUMMARY OF THE INVENTION

In view of the foregoing disadvantages inherent in the known types of shoe construction now present in the prior art, the present invention provides a pivoting shoe construction wherein the same permits a rear portion of a shoe to pivot relative to a forward portion of a shoe for access to the shoe. As such, the general purpose of the present invention, which will be described subsequently in greater detail, is to provide a new and improved pivoting shoe construction which has all the advantages of the prior art shoe constructions and none of the disadvantages.

To attain this, the present invention provides a shoe wherein the organization pivots about a pivot hinge mounted coextensively between an intersection of the shoe heel and the shoe sole permitting pivoting separation of a forward portion of the shoe relative to a rear portion of the shoe, wherein the forward portion of the shoe includes a bifurcated edge mounted at each right and left side thereof to receive an associated flange of the rear portion of the shoe, with a locking plunger mounted within each flange of the rear portion of the shoe. A modification of the invention includes a cavity directed within the forward portion of the shoe positioned medially and orthogonally relative to each slot to receive a deodorant packet therefrom, wherein the deodorant packet directs a deodorizing fluid through a permeable inner liner of the shoe construction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way It is therefore an object of the present invention to provide a new and improved pivoting shoe construction which has all the advantages of the prior art shoe constructions and none of the disadvantages.

It is another object of the present invention to provide a new and improved pivoting shoe construction which may be easily and efficiently manufactured and marketed.

It is a further object of the present invention to provide a new and improved pivoting shoe construction which is of a durable and reliable construction.

An even further object of the present invention is to provide a new and improved pivoting shoe construction which is susceptible of a low cost of manufacture with regard to both materials and labor, and which accordingly is then susceptible of low prices of sale to the consuming public, thereby making such pivoting shoe constructions economically available to the buying public.

Still yet another object of the present invention is to provide a new and improved pivoting shoe construction which provides in the apparatuses and methods of the prior art some of the advantages thereof, while simultaneously overcoming some of the disadvantages normally associated therewith.

Still another object of the present invention is to provide a new and improved pivoting shoe construction wherein the same utilizes scented replaceable packets mounted within associated cavities directed within confronting ends of a pivoting shoe organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those se forth above will become apparent when consideration is given to the following detailed description thereof. Such description makes reference to the annexed drawings wherein.

DESCRIPTION OF THE PREFERRED EMBODIMENT

Figure 1:
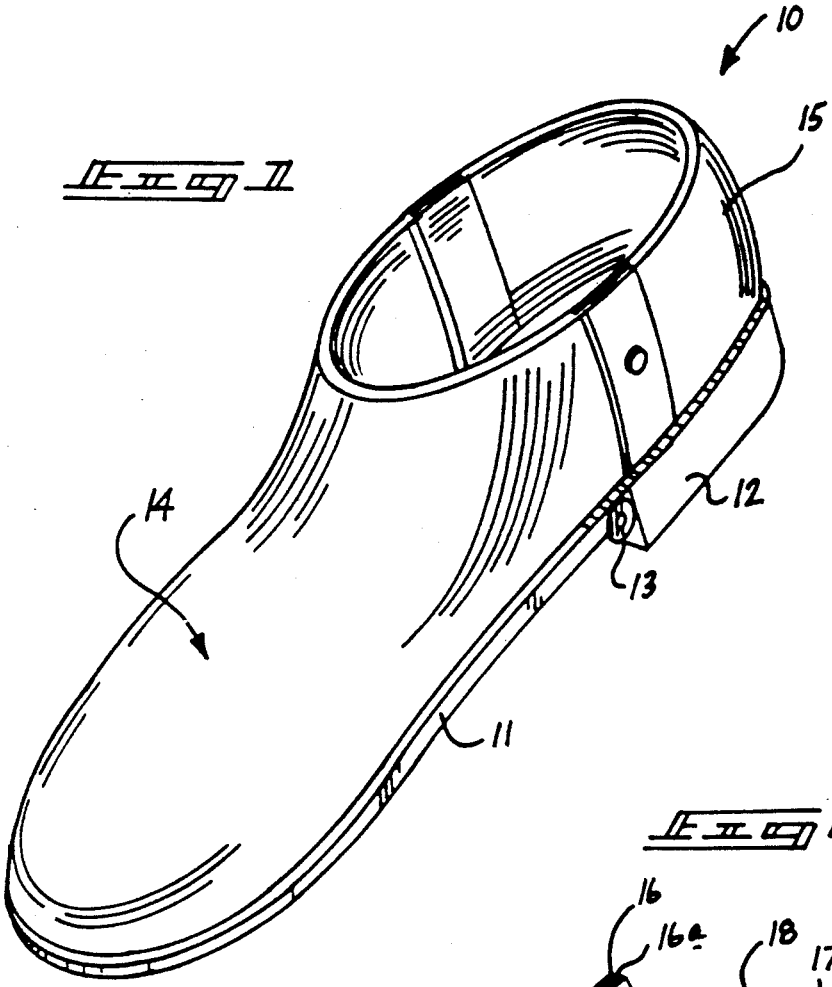
FIG. 1 is an isometric illustration of the instant invention.
Figure 2:
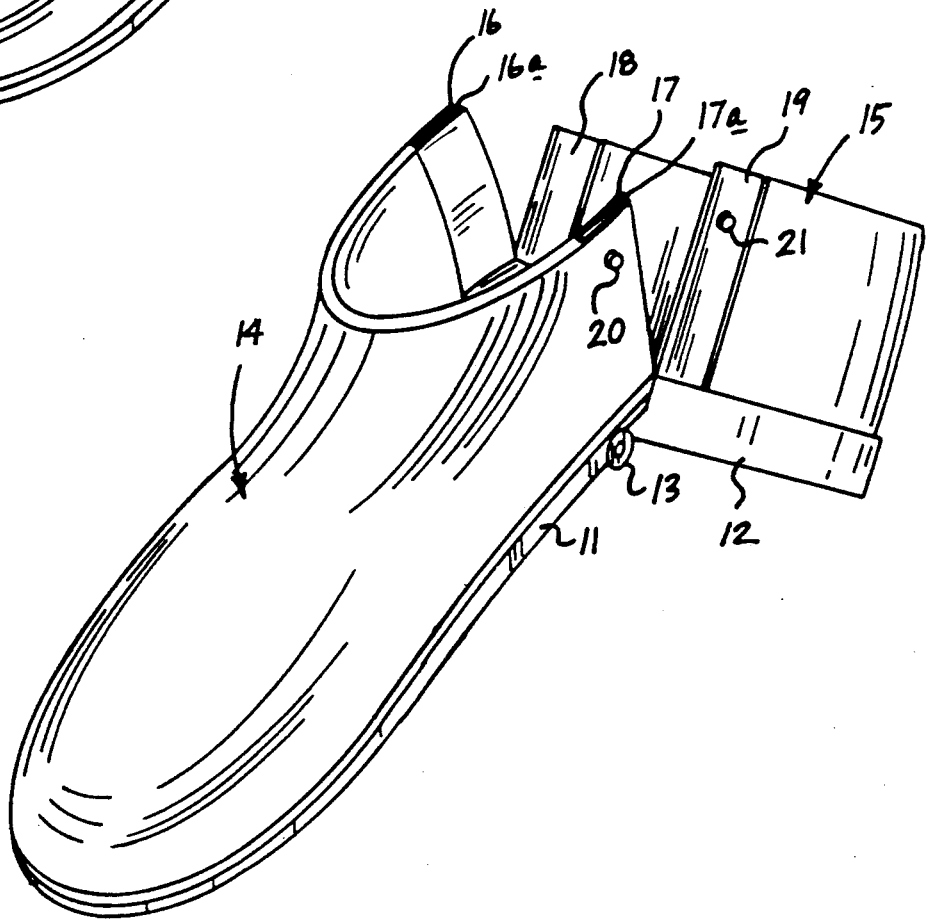
FIG. 2 is an isometric illustration of the instant invention in an opened configuration.
Figure 3:
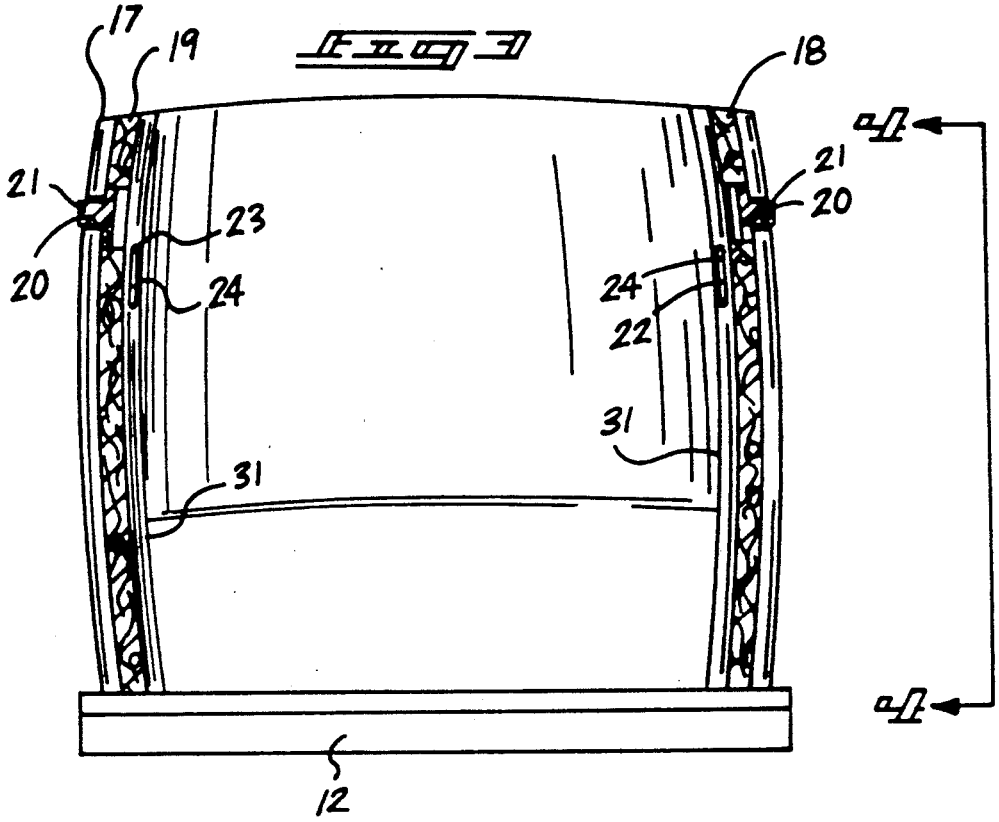
FIG. 3 is an orthographic cross-sectional configuration of the rear shoe portion.
Figure 4:
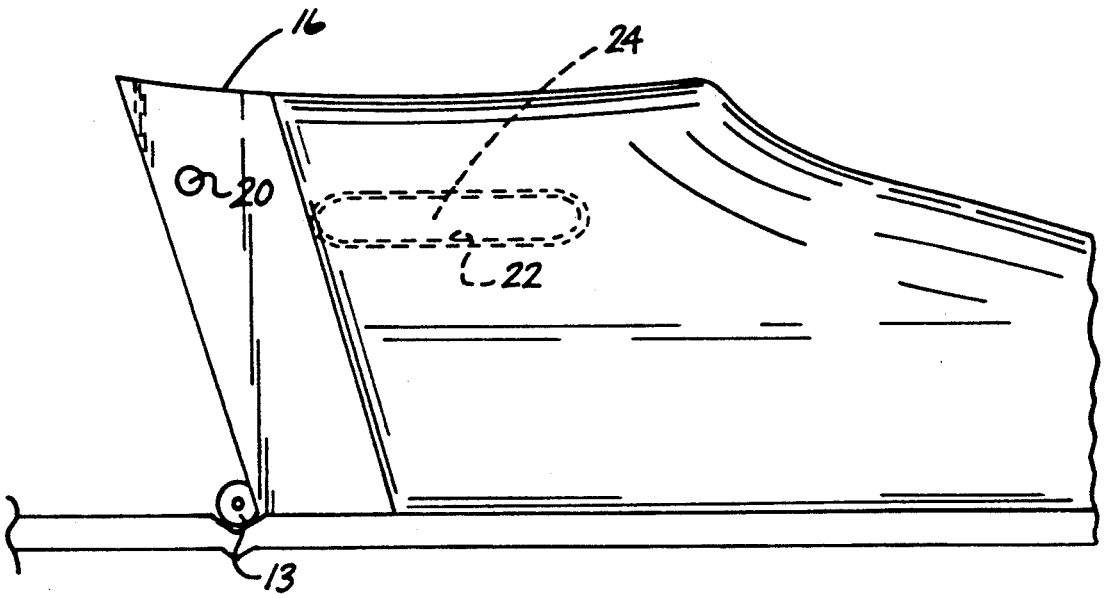
FIG. 4 is an orthographic view, taken along the lines 4—4 of FIG. 3 in the direction indicated by the arrows
Figure 5:
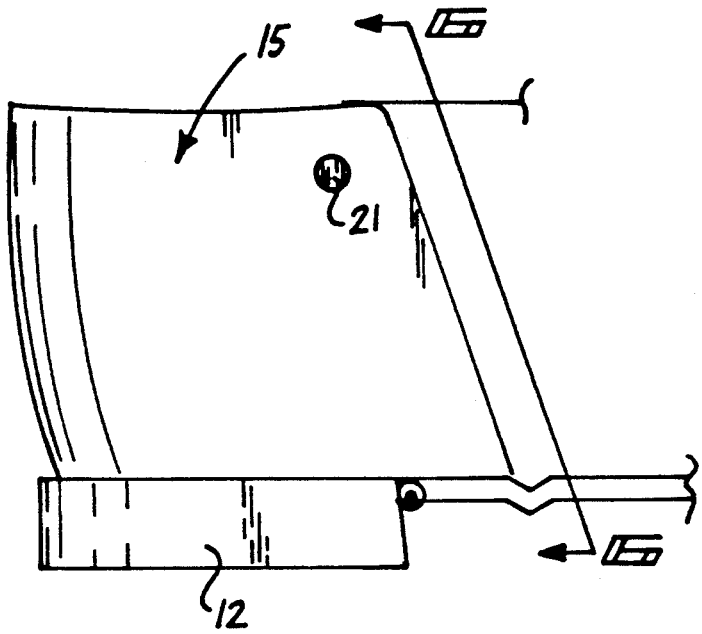
FIG. 5 is an orthographic side view of the rear portion of the shoe organization.
Figure 6:
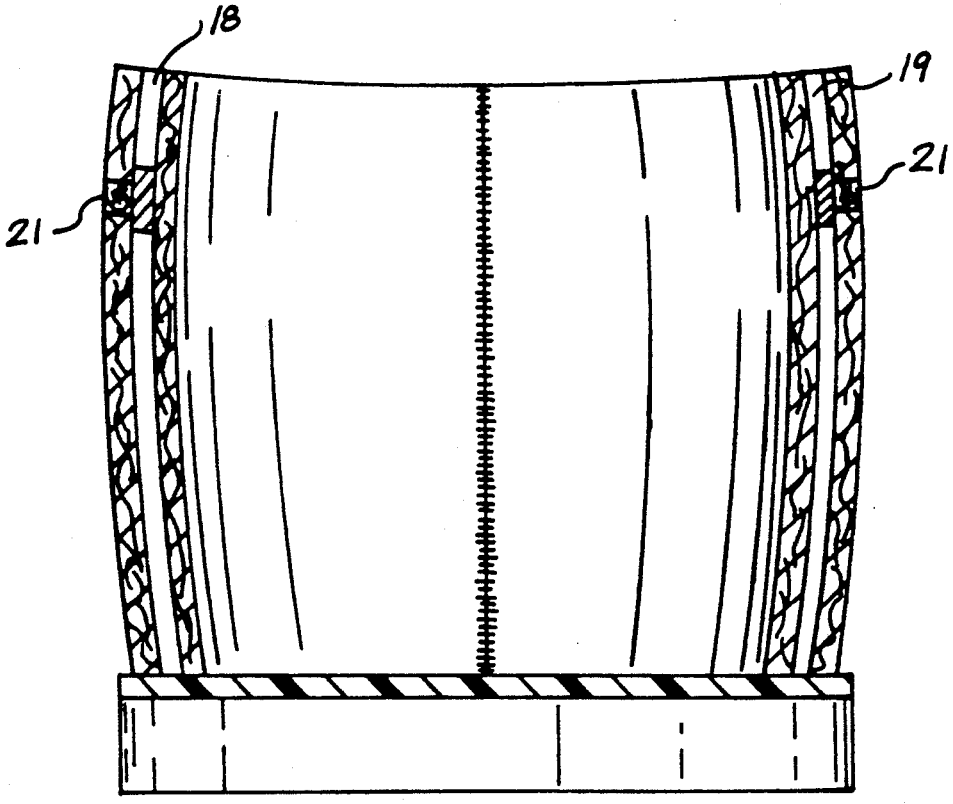
FIG. 6 is an orthographic view, taken along the lines 6—6 of FIG. 5 in the direction indicated by the arrows.
Figure 7:
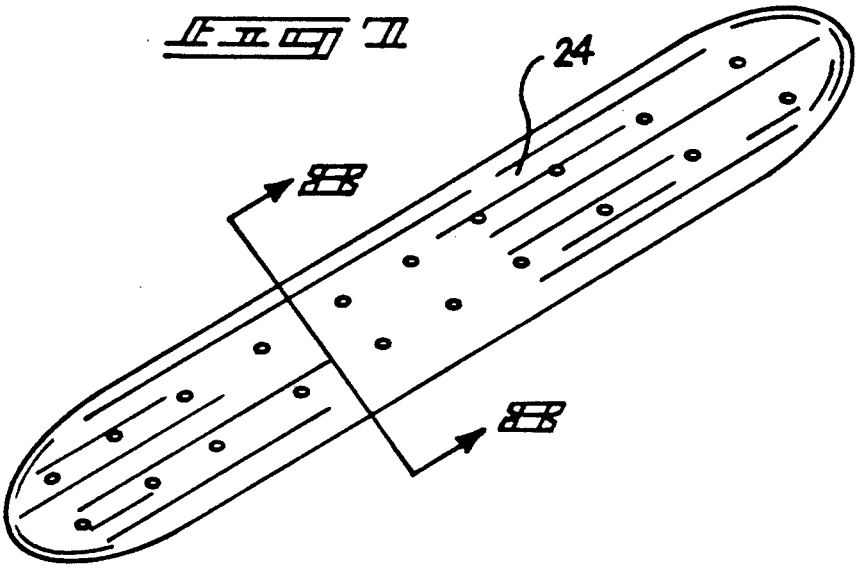
FIG. 7 is an isometric illustration of the replaceable packet member mounted within the associated cavity of the forward portion of the shoe.
Figure 8:
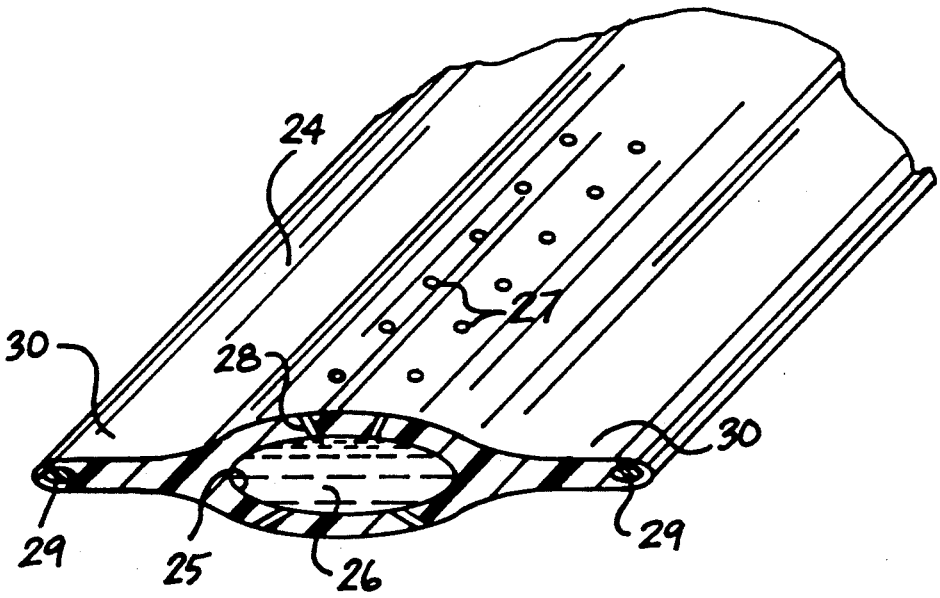
FIG. 8 is an orthographic view, taken along the lines 8—8 of FIG. 7 in the direction indicated by the arrows.

With reference now to the drawings, and in particular to FIGS. 1 to 8 thereof, a new and improved pivoting shoe construction embodying the principles and concepts of the present invention and generally designated by the reference numeral 10 will be described.

More specifically, the pivoting shoe construction 10 of the instant invention essentially comprises a shoe defined by a shoe sole 11 hingedly mounted to a shoe heel 12 at a pivot hinge 13 at an intersection coextensively of the shoe heel 12 and the shoe sole 11. An upper shoe forward section 14 is mounted to the shoe sole 11, with an upper shoe rear section 15 mounted to the shoe heel 12. The forward and rear sections 14 and 15 respectively are mainly securable relative to one another, wherein the upper shoe forward section 14 includes a bifurcated forward section rear first edge 16 spaced from and generally parallel a bifurcated forward section second edge 17. The bifurcated forward first and second edges 16 and 17 respectively define respective first and second slots **16*a* and 17*a*. The first and second slots 16*a* and 17*a* are spaced apart a predetermined spacing. The upper shoe rear section 15 includes a rear section first flange 18 complementarily receivable within the first slot 16*a*, with a rear section second flange 19 complementarily receivable in the second slot 17*a*, wherein the first and second flanges 18 and 19 respectively are spaced apart the predetermined spacing. A release button opening 20 is mounted through the bifurcated second edge 17, wherein optionally the bifurcated forward section first edge 16 may also include a like manner release button opening 20 cooperative with the release button 21 mounted within each of the first and second flanges 18 and 19. The release buttons may be of a spring-biased type, whereupon depressing of each release button projects each button below each associated opening 20 and 21 to permit pivotment of the forward section relative to the rear section about the associated hinge 13**.

Each of the slots defined by the first and second slots **16*a* and 17*a* include a respective first and second elongate cavity 22 and 23, each of a predetermined internal configuration extending from a rear wall of each slot oriented generally orthogonally relative to each slot for containing a respective elongate packet 24 within each cavity. Each packet is of a predetermined external configuration complementary to the predetermined internal configuration of each cavity to position each packet within each cavity. Each packet 24 includes a central packet fluid-filled cavity 25 containing a viscose fluid 26 therewithin, typically of a deodorant or fungicide solution that is directed into the interior of the shoe through a permeable shoe liner 31 extending within the interior surface of the upper shoe forward section 14. Each packet includes a plurality of openings 27 directed therethrough, with each opening 27 including an opening channel 28 in communication with the cavity 25 to direct the fluid 26 from the cavity through the channels 28 into the shoe interior through the permeable shoe liner 31. The packet is formed of a central section including packet wings that are arranged coextensively relative to one another in a coplanar relationship, with each packet wing 30 including a reinforcing rod 29**, wherein each of the rods are arranged in a parallel relationship to provide relative rigidity to the organization for insertion and removal relative to each of the cavities for replacement of the packets when depleted of fluid.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the part of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pivoting shoe construction, comprising, a shoe sole, the shoe sole including a shoe heel, the shoe sole and the shoe heel intersecting at an intersection line, wherein the intersection line includes a pivot hinge coextensive with the intersection lines to permit pivotment of the shoe sole relative to the shoe heel, and an upper shoe forward section mounted to the shoe sole, and an upper shoe rear section mounted to the shoe heel, wherein the upper shoe forward section and the upper shoe rear section includes latching means to secure the upper shoe forward section relative to the upper shoe rear section, and the upper shoe forward section includes a forward section bifurcated first rear edge spaced from and parallel a bifurcated forward section second rear edge spaced apart a predetermined spacing, wherein the first rear edge and the second rear edge define a respective first slot and second slot, and the upper shoe rear section includes a rear section first flange and a first section second flange, wherein the first flange is receivable within a first slot and the second fiange is receivable within a second slot, and the latching means includes a latch button mounted within the first flange and a further latch button mounted within the second flange, and the forward section bifurcated first year edge includes a first opening receiving the release button therewithin, and the forward edge bifurcated second edge includes a further opening to receive the further release button therewithin, and the first slot includes a first slot rear wall, and the second slot includes a second slot rear wall, and the first slot includes a first elongate cavity extending rearwardly of the first slot rear wall, and the second sot includes a second elongate cavity extending rearwardly of the second slot rear wall, wherein each slot receives an elongate dispensing packet therewithin, and the first slot and the second slot each are defined by a predetermined internal configuration, and each elongate dispensing packet is defined by a predetermined external configuration complementary configured to the predetermined internal configuration of each slot, and each dispensing packet includes a central portion defining an enclosed fluid-filled cavity, the fluid-filled cavity including a viscose fluid contained therewithin, and the central portion includes a plurality of apertures directed through the central portion, with each opening including an opening channel in fluid communication with the fluid-filled cavity, and the upper shoe forward section including a permeable shoe liner to direct the fluid from the fluid-filled cavity through the permeable liner interiorly of the upper shoe forward section, and the dispensing packet includes a plurality of wings extending coextensively of the central portion, wherein the wings are coplanar relative to one another, and each wing includes a reinforcing rod directed therethrough, wherein each of the rods are arranged at a parallel relationship to maintain geometric integrity of each dispensing packet.

* * * * *